United States Patent [19]

Fukao et al.

[11] Patent Number: 4,977,842

[45] Date of Patent: Dec. 18, 1990

[54] OVERLOCK SEWING MACHINE WITH A THREADING MECHANISM FOR EASILY THREADING A LOOPER

[75] Inventors: Hiroaki Fukao, Kasugai; Teruhiko Ohkita, Nagoya; Nobusuke Nagasaka, Aichi; Yukio Ichihara, Tajimi; Toshio Sasaki, Inazawa, all of Japan

[73] Assignee: Brother Kogyo Kabushiki Kaisha, Japan

[21] Appl. No.: 357,263

[22] Filed: May 26, 1989

[30] Foreign Application Priority Data

May 31, 1988 [JP] Japan ..... 63-135191
Feb. 23, 1989 [JP] Japan ..... 1-44944

[51] Int. Cl.[5] ..... D05B 57/00; D05B 57/02

[52] U.S. Cl. ..... 112/199; 112/162; 112/165; 112/270; 112/302; 112/154

[58] Field of Search ..... 112/154, 159, 162, 163, 112/165, 166, 197, 199, 202, 218, 262.1, 269.1, 224, 225, 302

[56] References Cited

U.S. PATENT DOCUMENTS

| | | | |
|---|---|---|---|
| 541,518 | 6/1895 | Woodward | 112/165 |
| 1,000,134 | 8/1911 | Weis | 112/162 |
| 2,265,678 | 12/1941 | Summers | 112/162 |
| 2,778,329 | 1/1957 | Howell et al. | 112/199 |
| 3,333,560 | 8/1967 | Wiener et al. | 112/199 |
| 3,465,701 | 9/1969 | Walling | 112/245 |
| 3,722,438 | 3/1973 | Schinzel | 112/199 |
| 4,356,782 | 11/1982 | Ueyama et al. | 112/197 |
| 4,373,460 | 2/1983 | Parker et al. | 112/162 |
| 4,649,841 | 3/1987 | Koshinaka | 112/129 |
| 4,649,843 | 3/1987 | Muroi | 112/270 |
| 4,690,080 | 9/1987 | Mikuni et al. | 112/162 |

FOREIGN PATENT DOCUMENTS

| | | |
|---|---|---|
| 59-188078 | 12/1984 | Japan . |
| 61-77964 | 5/1986 | Japan . |
| 3240895 | 10/1988 | Japan . |

*Primary Examiner*—Werner H. Schroeder
*Assistant Examiner*—Ismael Izaguirre
*Attorney, Agent, or Firm*—Oliff & Berridge

[57] ABSTRACT

This invention provides an overlock sewing machine with a threading mechanism that is both easier and more efficient to use. As shown in FIGS. 1 and 7, the overlock sewing machine has a vertically movable needle (6, 106), a looper carriage (18, 118) connected to a rotating shaft, and a looper (11, 111) on the end of the looper carriage. The looper extends laterally over the looper carriage and has a thread-receiving eye (11*a*, 111*a*). The looper and the needle cooperate to form a chain stitch. As shown in FIGS. 3 and 9, a thread-guiding member (25, 125) next to the looper pivots with the looper to guide a thread LT through the thread-receiving eye. A movable lever (30, 130) pivots with or relative to the looper. A thread-delivering member (39, 139) mounted on the movable lever that can be set in two positions: a first position corresponding to a first position of the thread-receiving eye, and a second position corresponding to the thread-guiding member. In the second position, the thread passes through the thread-guiding member.

13 Claims, 8 Drawing Sheets

1
2
3
4
5
6
6a
10
11
11a
13
14
16
16a
17
18
19
30
39
47

OVERLOCK SEWING MACHINE WITH A THREADING MECHANISM FOR EASILY THREADING A LOOPER

BACKGROUND OF THE INVENTION

This invention relates to an overlock sewing machine with a threading mechanism for easily threading a looper.

A conventional under-looper extends horizontally under a sewing machine bed. A needle plate located right above the under-looper, and components located around the under-looper, obstruct and complicate the threading of the under-looper.

To facilitate the threading operation, a looper is proposed in Japan Published Unexamined Utility Model application No. S59-188078.A movable arm, at the tip of which is a thread guide, is mounted on a looper carriage. First, the arm is inclined under the sewing machine bed, then the thread guide is threaded. When the arm is raised, thread is delivered from the yarn guide to the looper.

An overlock sewing machine is proposed in Japan Published Unexamined Utility Model application No. S61-77964.A rotatable lever, at the tip of which is a looper, is connected to or disconnected from a looper carriage by using a knob. When the looper is threaded, the rotatable lever should be detached from the looper carriage using the knob, and the rotatable lever should be turned until the looper emerges from an opening of a sewing machine frame.

However, in these prior-art machines, the looper must be threaded below the sewing machine bed. An operator must look into the sewing machine bed, and thread the looper, which is located near the bottom of the sewing machine. If the operator forgets to raise the arm and starts the sewing machine, the thread would slacken and a neat stitch could not be formed.

In the latter prior art, Japan Published Unexamined Utility Model application No. S61-77964,the threading operation is complicated. For example, the rotatable lever must be turned aside, and the position of the rotatable lever must be adjusted by loosening and tightening the knob.

SUMMARY OF THE INVENTION

The object of this invention is to provide an overlock sewing machine with a threading mechanism for easily threading a looper so as to improve the efficiency of the threading operation.

This object is achieved by this invention which provides an overlock sewing machine, as shown in FIGS. 1 and 7 including at least one vertically movable needle (6,106), a looper carriage (18,118) connected to a rotating shaft, and a looper (11,111) that connects to the looper carriage (18,118) at one end. The looper has a thread-receiving eye (**11*a*,111*a*) at the other end, and extends laterally over the looper carriage (18,118). The vertically movable needle (6,106) forms a chain stitch in cooperation with the looper (11,111). The overlock sewing machine comprises a thread-guiding member (25,125) on the looper (11,111), a movable lever (30,130), and a thread-delivering member (39,139). The thread-guiding member moves with the looper (11,111) for guiding a thread through the thread-receiving eye (11*a*,111*a*). The movable lever (30,130) moves both with the looper (11,111) and relative to the looper (11,111). The thread-delivering member (39,139) mounted on the movable lever (30,130) moves between two positions, holds the thread when in a first position corresponding to the thread-receiving eye (11*a*,111*a*), and delivers the thread through a thread-guiding member (25,125) when in a second position corresponding to the thread-guiding member (25,125**).

BRIEF DESCRIPTION OF THE DRAWINGS

By way of example and to make the description clearer, reference is made to accompanying drawings in which.

DETAILED DESCRIPTION OF PREFERRED EMBODIMENTS

Figures 1, 2:
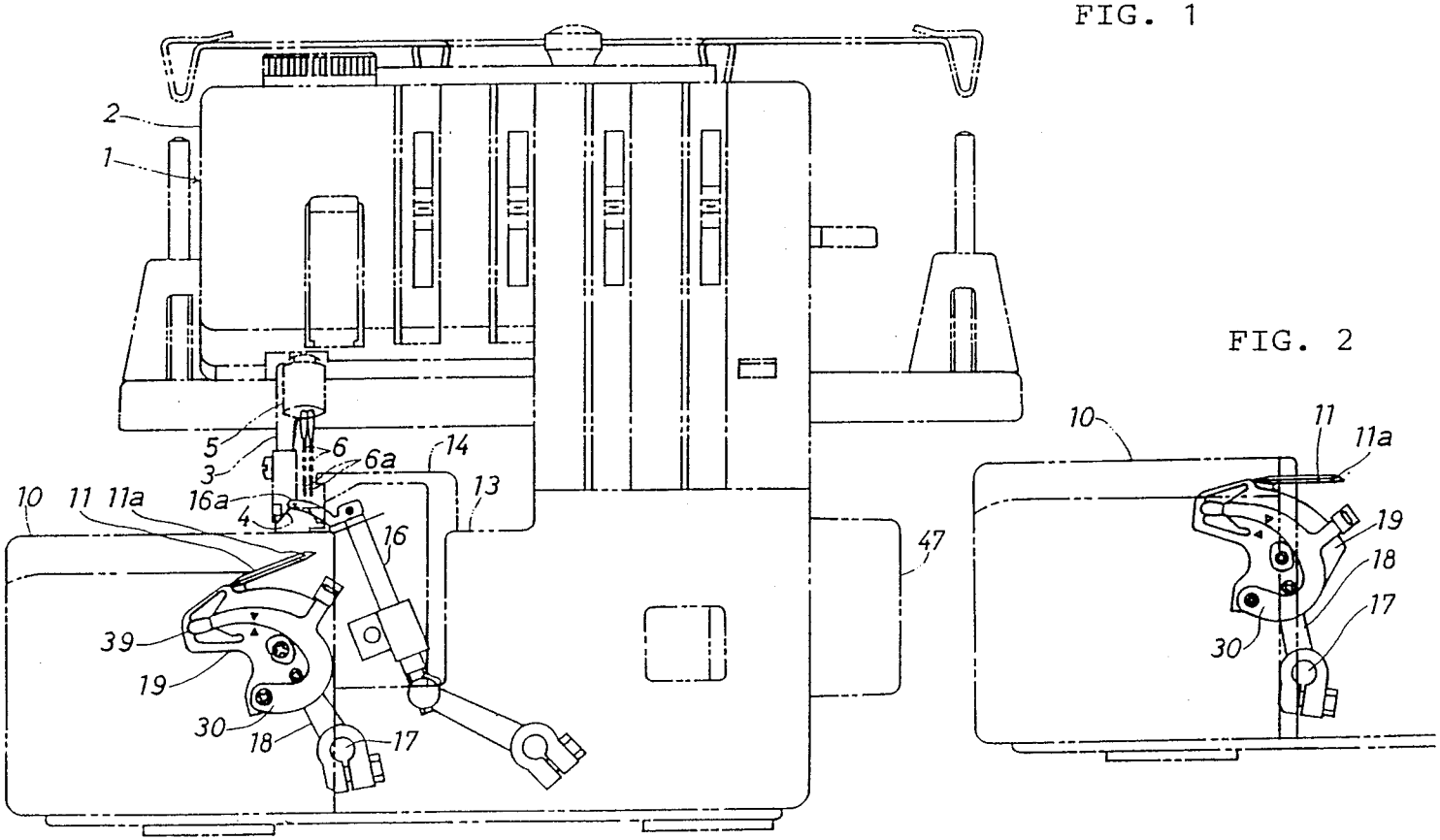
FIG. 1 is a front view of an overlock sewing machine embodying the present invention.
FIG. 2 is a front view of a threading mechanism for a first embodiment.

As shown in FIG. 1, a presser foot 4 is attached through a presser bar 3 to an arm 2 of a sewing machine body 1. Two vertically movable needles 6 are attached through a needle bar 5 to the arm 2. A known needle thread is supplied from a known tension stud through eyes **6*a* in the needles 6**.

An under-looper 11 and an over-looper 16 are housed in the lower part of the sewing machine body 1. Looper thread is supplied from the tension stud and a known looper-thread take-up through thread-receiving eyes **11*a* and 16*a* at the tip of the loopers 11 and 16. The loopers 11 and 16 form a chain stitch on a known fabric using needle thread and looper thread in cooperation with the needles 6**.

An openable cover 13 covers the front face of the lower part of the sewing machine body 1 except a bed 10. A guide plate 14 guides the edge of the fabric cut by a known cutter. The guide plate 14 can open together with the cover 13.

The under-looper 11 and its related structure are explained in detail.

Figure 3A:
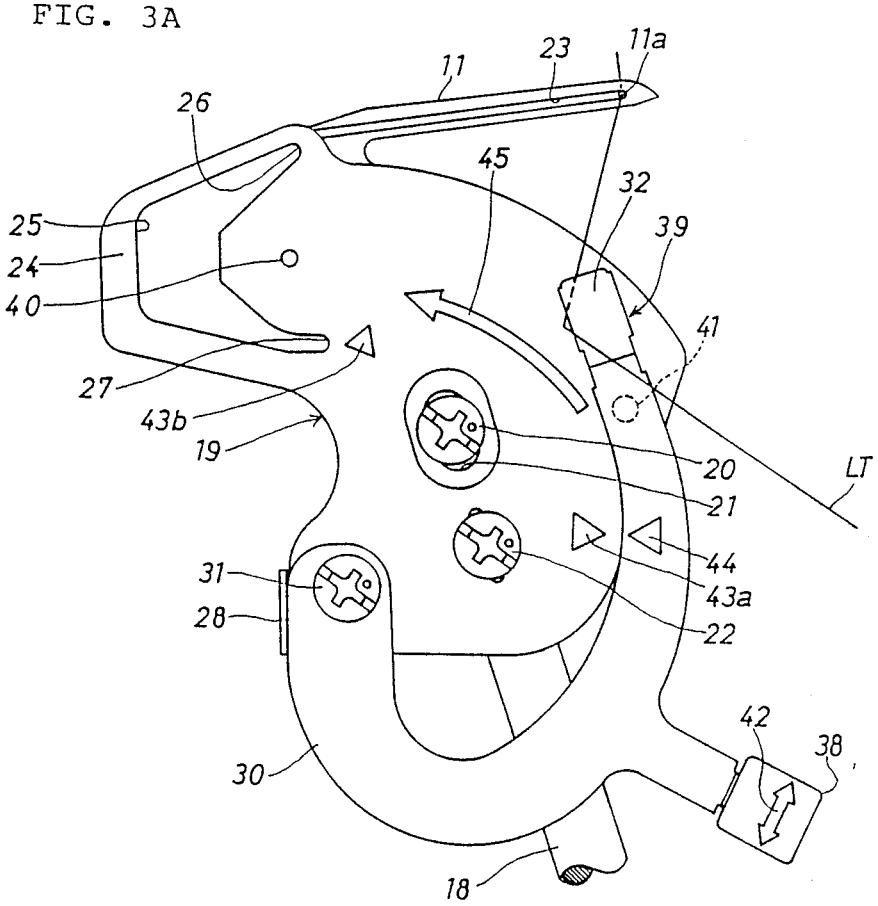
FIG. 3A is a front view of the threading mechanism when a thread-delivering member is in its first position.
Figure 3B:
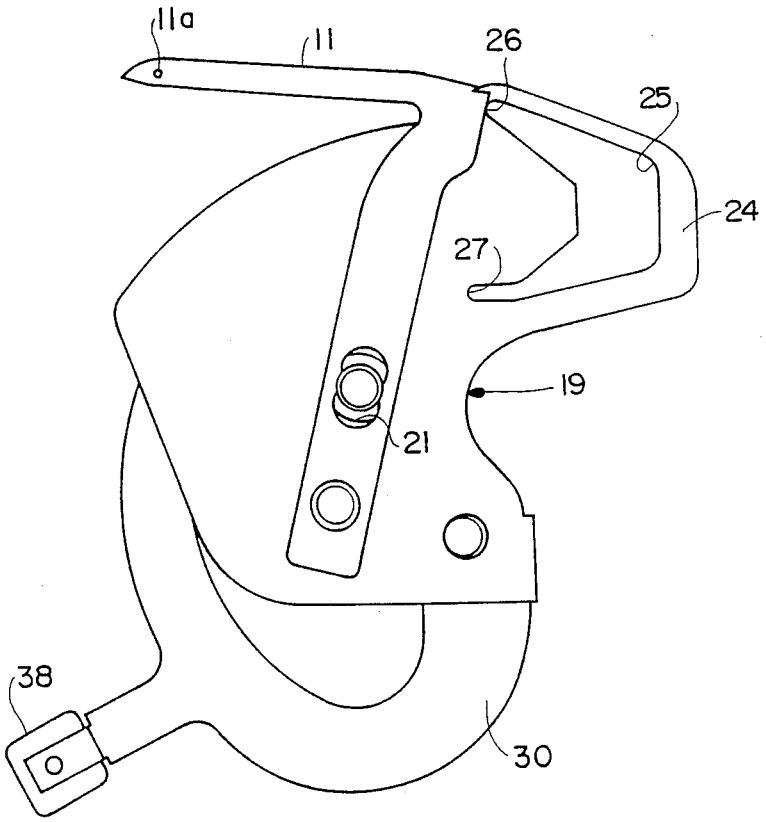
FIG. 3B is a back view of FIG. 3A.
Figure 5:
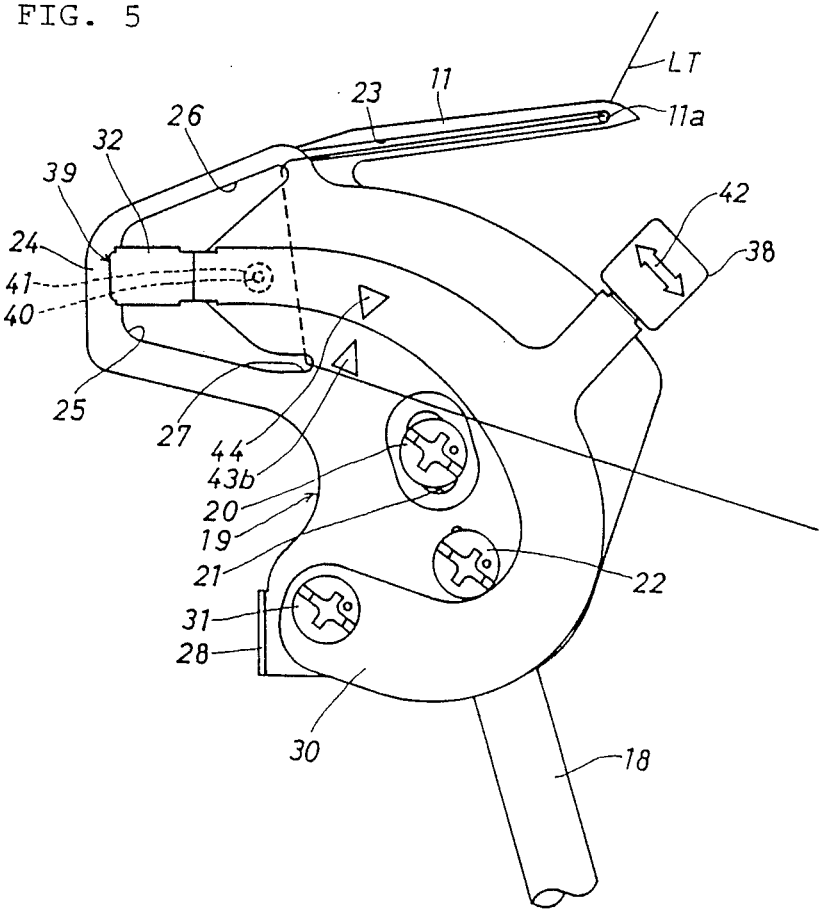
FIG. 5 is a front view of the threading mechanism when the thread-delivering member is in its second position.

In the sewing machine body 1, a pivoting looper carriage 18 is mounted on a carriage shaft 17 connected to a known main shaft. As shown in FIGS. 3A, 3B and 5, below the bed 10, the under-looper 11 is fixed in a long hole 21 at the upper end of the looper carriage 18 by a set screw 20. The position of the under-looper 11 can be vertically adjusted using the set screw 20. The under-looper 11 has in its front face a thread-receiving groove 23 extending longitudinally from the thread-receiving eye 11*a*. Adjacent to the end opposite the thread-receiving eye 11*a* of the under-looper 11, a threading base 19 is fixed by a set screw 22. The threading base 19 has a projection 24 in its left side. The projection 24 and the threading base 19 surround a laterally V-shaped thread-guiding hole 25. The upper part of the projection 24 is fixed to the end of the upper looper 11. Looper thread LT is guided from an upper curved portion 26 of the thread-guiding hole 25 through the thread-receiving eye 11*a*. The looper thread LT is guided from the looper thread take-up into a lower curved portion 27 of the thread-guiding hole 25.

At the lower end of the threading base 19, a curved lever 30 is rotatably attached by a set screw 31.

Figure 4:
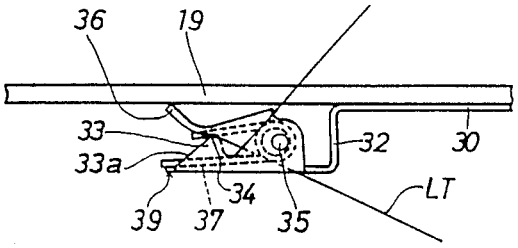
FIG. 4 is a side view of the thread-delivering member in FIG. 3A.
Figure 6:
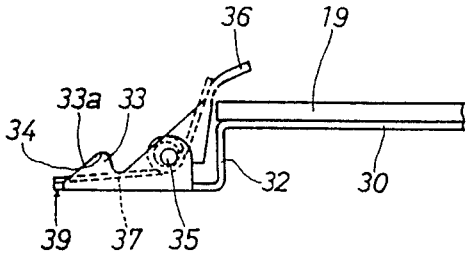
FIG. 6 is a side view of the thread-delivering member in FIG. 5.

As shown in FIGS. 4 and 6, at the free end of the curved lever 30, an L-shaped thread guard 32 is formed. The thread guard 32 leads to a curved portion 34 for holding the looper thread LT in position, a bent portion 33, and a sloping end 33*a* for guiding the looper thread LT to the curved portion 34. Between side bent portion 33, a rotating member 36 is mounted on a pin 35. The rotating member 36 holds and releases the looper thread LT. Between the rotating member 36 and the thread guard 32, a spring 37 is attached. The spring 37 forces the rotating member 36 to release the looper thread LT. In the middle of the curved lever 30, a handle 38 is attached to operate the curved lever 30.

The thread guard 32 and the rotating member 36 compose a thread-delivering member 39. As shown in FIGS. 3A, 3B and 4 the thread-delivering member 39 and the curved lever 30 are moved to a first position or a second position on the threading base 19 using the handle 38. In the first position, the thread-delivering member 39 faces the thread-receiving eye 11*a* of the under-looper 11. As shown in FIGS. 5 and 6, in the second position, the thread-delivering member 39 reaches the thread-guiding hole 25. As shown in FIGS. 3 and 4, when the thread-delivering member 39 is in the first position, the rotating member 36 of the thread-delivering member 39 abuts against the threading base 19 and resists the force of the spring 37. The rotating member 36 holds the looper thread LT in the curved portion 34. As shown in FIGS. 5 and 6, when the thread-delivering member 39 is in the second position, the rotating member 36 is released from the threading base 19, thus opening due to the force of the spring 37, and conveying the looper thread LT through the thread-guiding hole 25.

When the thread-delivering member 39 is in the first position, a stopper 28 on the threading base 19 blocks a portion of the curved lever 30 and prevents the curved lever 30 from turning further clockwise. On the other hand, when a hole 40 in the threading base 19 engages with a projection 41 of the curved lever 30, the thread-delivering member 39 is held in the second position. The curved lever 30 abuts against the set screw 22, and so is prevented from rotating counterclockwise from the second position. The handle 38 has on its face arrows 42 indicating the rotating directions of the curved lever 30. The curved lever 30 has on its front face a lever mark 44 that aligns with a first-position mark 43*a* or a second-position mark 43*b* on the threading base 19 when the curved lever 30 is held in the first or second position, respectively. The threading base 19 has an arrow 45 which indicates the proper position of the curved lever 30 when the sewing machine is operating. In FIG. 1, a manual pulley 47 is located at the lower right side of the sewing machine body 1.

The operation of this construction is now explained.

In FIG. 1, the sewing machine is stopped, and the under-looper 11 is in the second position. To thread the under-looper 11 when it is in this position, the cover 13 is opened, and the looper carriage 18 is turned clockwise using the manual pulley 47. As shown in FIG. 2, the thread-receiving eye 11*a* of the under-looper 11 comes out from under the bed 10. Subsequently, the curved lever 30 is pushed downward using the handle 38 until the lever mark 44 meets the first-position mark 43*a*. As shown in FIGS. 3 and 4, the thread-delivering member 39 is thus located in the first position outside the bed 10, where the under-looper 11 may be easily threaded.

The looper thread LT is guided from the looper-thread take-up toward the lower left side of the thread-delivering member 39. The guided looper thread LT is pulled along the sloping end 33*a* and is held in the curved portion 34. The thread-receiving eye 11*a* of the under-looper 11 is then threaded. While the thread-receiving eye 11*a* is threaded, the thread-delivering member 39 is outside the bed 10, and the thread-receiving eye 11*a* is almost as high as the bed 10. The thread-receiving eye 11*a* is thus in the sight of an operator, which facilitates the threading operation. Since the left side of the thread-delivering member 39 is open in the form of a "V", the looper thread LT can easily be caught in the curved portion 34. Furthermore, since the thread-delivering member 39 in the first position is right below the thread-receiving eye 11*a* of the under-looper 11, the looper thread LT from the curved portion 34 can easily be guided through the thread-receiving eye 11*a*.

Next, the handle 38 is pushed up, and the curved lever 30 is rotated until the lever mark 44 meets the second-position mark 43*b*. As shown in FIGS. 5 and 6, the hole 40 engages the projection 41, and the thread-delivering member 39 is located in the second position. The rotating member 36 is then released from the threading base 19, and the spring 37 forces the tip of the rotating member 36 to open and project past the rear side of the threading base 19. The looper thread LT is thus released from the curved portion 34.

When the sewing machine is started while the thread-delivering member 39 is in the second position, the looper thread LT is released from the thread-delivering member 39 due to tension caused during stitch formation. The looper thread LT becomes taut between the lower curved portion 27 and the upper curved portion 26, and tightens against the thread-receiving groove 23, and passes through the thread-receiving eye 11*a*. The threading operation is thus completed.

As explained, the under-looper 11 can be easily threaded simply by putting the looper thread LT through the thread-delivering member 39 and rotating the curved lever 30 counterclockwise. After this threading operation, the looper thread LT is released from the curved lever 30, and placed between the lower curved portion 27 and the upper curved portion 26. If the thread-delivering member 39 is carelessly moved from the second position to the first position, the looper thread LT will not leave the thread-guiding hole 25. Therefore, the looper thread will not slacken. A neat chain stitch can thus be formed without any slackening.

In this embodiment, the curved lever 30 is rotatably attached to the threading base 19. However, the curved lever 30 could also be attached to the looper carriage 18 or to the carriage shaft 17.

Another embodiment is now explained with reference to FIGS. 7–12. In this second embodiment, the components with functions identical or analogous to those in the first embodiment are designated by reference numerals retaining the last two digits from the first embodiment. In addition to the identical components, the components whose function or configuration has changed, and the new components are explained.

Figure 9A:
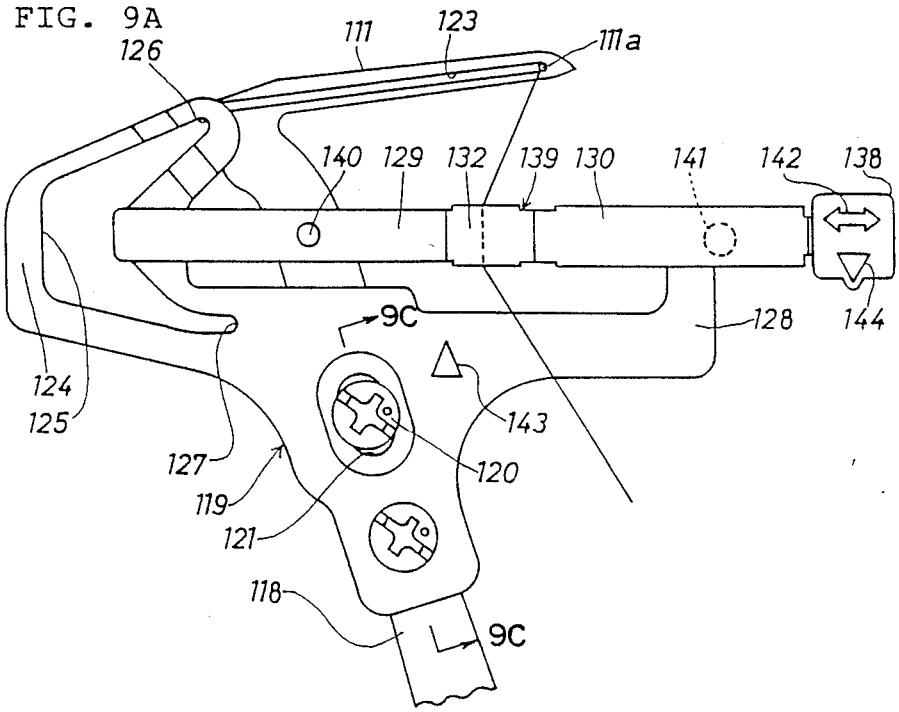
FIG. 9A is a front view of the threading mechanism when a thread-delivering member is in its first position.
Figure 9B:
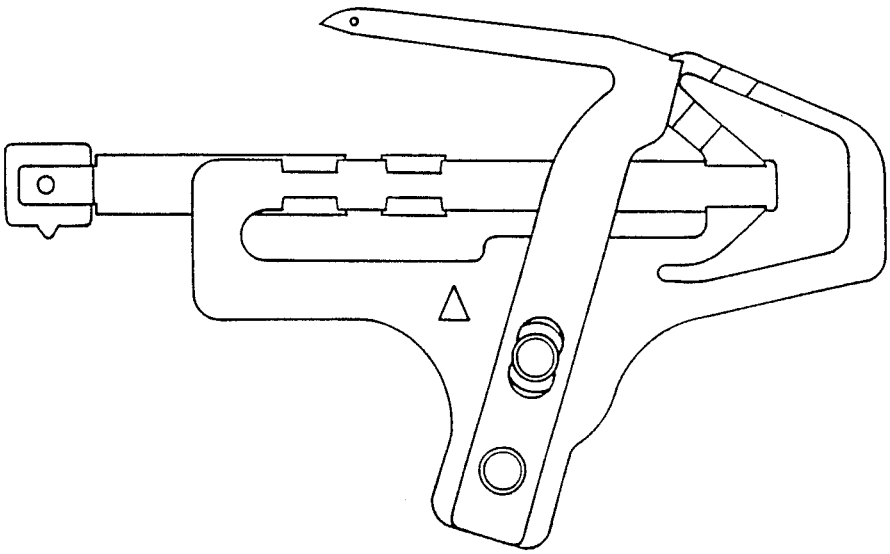
FIG. 9B is a back view of FIG. 9A.
Figure 9C:
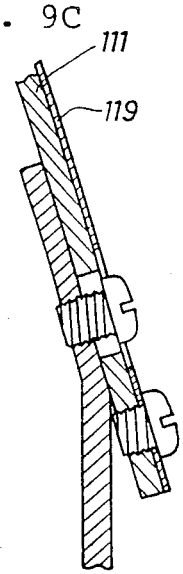
FIG. 9C is a sectional view of FIG. 9A, and the section is taken along line IX—IX in Fig. 9A.
Figure 10:
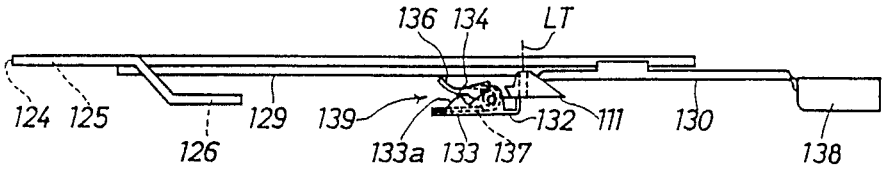
FIG. 10 is a side view of the thread-delivering member in FIG. 9A.

As shown in FIG. 9A, a guide rail 129 is fixed between a projection 124 and a slide carriage 128 projecting from the right side of a threading base 119, and extends roughly parallel to an under-looper 111. A slide 130 is slidably attached to the guide rail 129. The slide 130 is shorter than the guide rail 129. As shown in FIG. 10, a handle 138 is attached to the right end of the slide 130 for sliding the slide 130.

Figure 12:
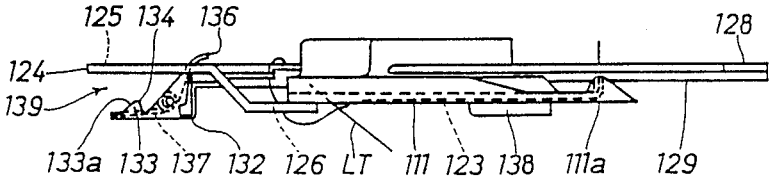
FIG. 12 is a side view of the thread-delivering member in FIG. 11.
Figure 11:
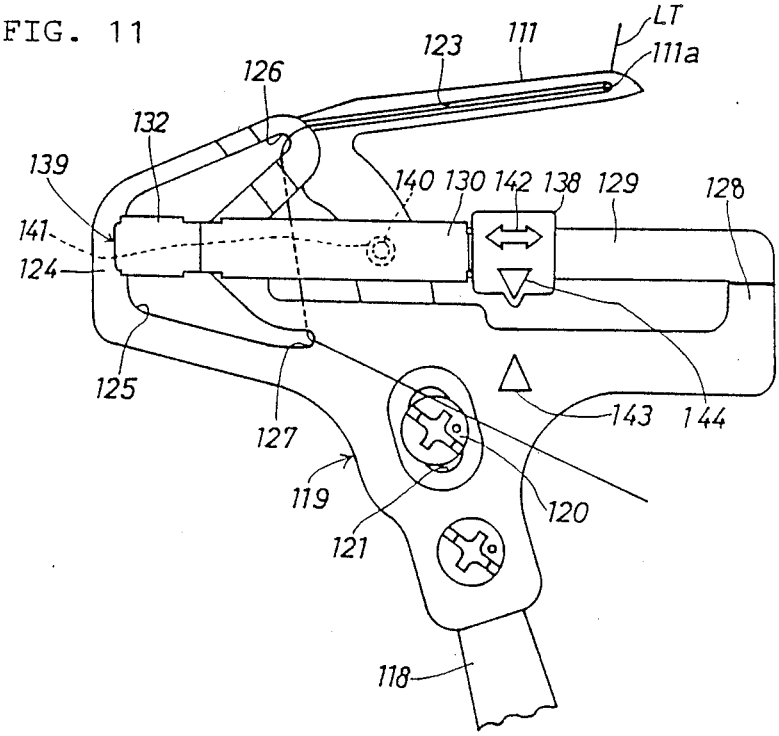
FIG. 11 is a front view of the threading mechanism when the thread-delivering member is in its second position.

A thread-delivering member 139 and the slide 130 are slid on the guide rail 129 using the handle 138. The thread-delivering member 139 slides between a first position and a second position. As shown in FIGS. 9A and 10, when the thread-delivering member 139 is in the first position, the thread-delivering member 139 faces a thread-receiving eye 111*a* of the under-looper 111. As shown in FIGS. 11 and 12, when the thread-delivering member 139 is in the second position, the thread-delivering member 139 is at a thread-guiding hole 125. In the first position, a rotating member 136 of the thread-delivering member 139 abuts against the guide rail 129, resists the force of a spring 137, and remains closed. The looper thread LT is held in a curved portion 134. In the second position, the rotating member 136 disengages from the guide rail 129, and opens due to the force of the spring 137. The looper thread LT is released from the rotating member 136 into the thread-guiding hole 125.

When the thread-delivering member 139 is in the first position, the slide carriage 128 of the threading base 119 is blocked by a portion of the slide 130, preventing the slide 130 from sliding further to the right. On the other hand, when a hole 140 in the guide rail 129 engages a projection 141 of the slide 130, the thread-delivering member 139 is fixed in the second position. The handle 138 has on its front face arrows 142 indicating the sliding directions of the slide 130, and a slide mark 144 which aligns with a second-position mark 143 on the threading base 119 when the thread-delivering member 139 is in the second position.

The operation of this construction is now explained.

Figure 7:
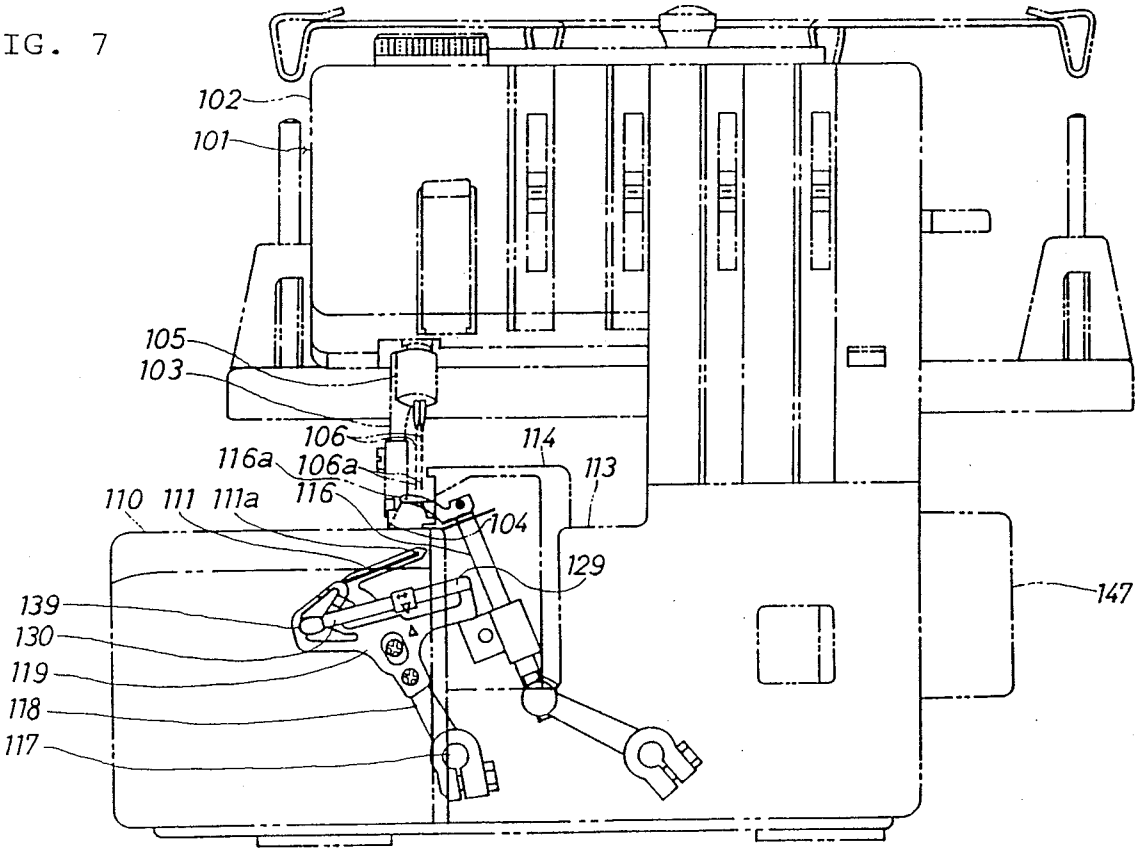
FIG. 7 is a front view of a second overlock sewing machine embodying the present invention.
Figure 8:
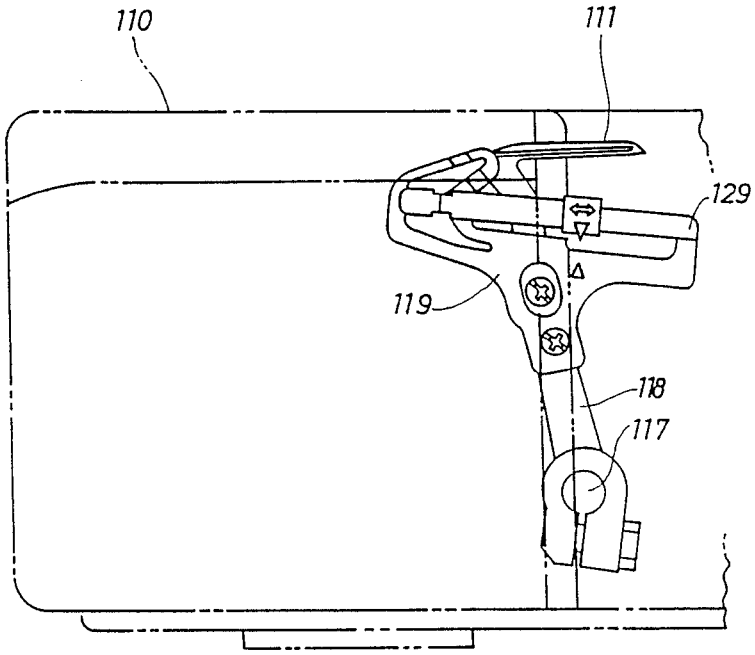
FIG. 8 is a front view of a threading mechanism for a second embodiment.

In FIG. 7, the sewing machine is stopped, and the under-looper 111 is in the second position. To thread the under-looper 111 when it is in this position, a cover 113 is opened, and a looper carriage 118 is turned clockwise using a manual pulley 147. As shown in FIG. 8, the thread-receiving eye 111*a* of the under-looper 111 comes out from under a bed 110. Next, the slide 130 is pulled to the right side using the handle 138. As shown in FIGS. 9A, 9B, 9C and 10, the thread-delivering member 139 is thus located in the first position and outside the bed 110, where the under-looper 111 is easily threaded.

Next, as shown in FIG. 10, the looper thread LT is guided from the looper-thread take-up toward the left side of the thread-delivering member 139. The guided looper thread LT is pulled along a sloping end 133*a* and is held in the curved portion 134. The thread-receiving eye 111*a* of the under-looper 111 is then threaded. While the thread-receiving eye 111*a* is threaded, the thread-delivering member 139 is outside the bed 110, and the thread-receiving eye 111*a* is almost as high as the bed 110. The thread-receiving eye 111*a* is thus in the sight of an operator, which facilitates the threading operation. Since the left side of the thread-delivering member 139 is open in the form of a "V", the looper thread LT can easily be caught in the curved portion 134. Furthermore, since the thread-delivering member 139 in the first position is right below the thread-receiving eye 111*a* of the under-looper 111, the looper thread LT from the curved portion 134 can easily be guided through the thread-receiving eye 111*a*.

Next, the handle 138 is pushed to the left side, and the slide 130 is moved until the slide mark 144 aligns with the second-position mark 143. As shown in FIGS. 11 and 12, the hole 140 engages the projection 141, and the thread-delivering member 139 is located in the second position. The rotating member 136 is then released from the guide rail 129, and the spring 137 forces the tip of the rotating member 136 to open and project past the rear side of the projection 124. The looper thread LT is thus released from the curved portion 134.

When the sewing machine is started while the thread-delivering member 139 is in the second position, the looper thread LT is released from the thread-delivering member 139 due to tension caused during stitch formation. The looper thread LT becomes taut through between a lower curved portion 127 and an upper curved portion 126, and further tightens against a thread-receiving groove 123, and passes through the thread-receiving eye 111*a*. The threading operation is thus completed.

As explained, the under-looper 111 can be easily threaded simply by putting the looper thread LT through the thread-delivering member 139 and sliding the slide 130 to leftward. After this threading operation, the looper thread LT is released from the slide 130 to between the lower curved portion 127 and the upper curved portion 126. If the thread-delivering member 139 is carelessly moved from the second position to the first position, the looper thread LT will not leave the thread-guiding hole 125. Therefore, the looper thread will not slacken. A neat chain stitch can thus be formed without slackening.

In these embodiments, the thread-delivering member 39 (139) is provided with the spring 37 (137). However, since the rotating member 36 (136) opens due to thread tension during stitch formation, the spring 37 (137) can be removed from the construction of these embodiments. In these embodiments, when the sewing machine is started, the thread delivering member 39 (139) is in the second position. However, after the threading operation, the looper thread LT will not leave the thread-guiding hole 25 (125). Consequently, the thread-delivering member 39 (139) can be returned to the first position when the sewing machine is started.

These are only possible a few of the embodiments of the invention claimed below. These embodiments are only illustrations of the claims, and in no way restrict the scope of the claims.

What is claimed is:

1. An overlock sewing machine including at least one vertically movable needle, a looper carriage connected to a rotating shaft, a looper having a groove and connected to the looper carriage at one end, and having a thread-receiving eye at the other end, and extending laterally over the looper carriage, where the vertically movable needle forms a chain stitch in cooperation with the looper, the overlock sewing machine comprising:

a thread-guiding member on the looper moving with the looper for guiding a thread into the thread-receiving groove;

a movable lever for moving both with the looper and relative to the looper; said movable lever having a free end; and a thread-delivering member mounted on the movable lever, which moves between two positions, for holding the thread when in a first position corresponding to the thread-receiving eye, and for delivering the thread through the thread-guiding member when in a second position corresponding to the thread-guiding member.

2. An overlock sewing machine according to claim 1, in which the thread-delivering member comprises:

an L-shaped thread guide at the free end of the movable lever leading to a catch for holding the thread in position;

side portions comprising the catch and a sloping end for guiding the thread into the catch;

a rotating member mounted on a pin for holding the thread in the catch; and a spring for forcing the rotating member to release the thread.

3. An overlock sewing machine according to claim 1, and further comprising a handle, and means for attaching the handle to the movable lever to move the movable lever with the thread-delivering member between the first position and the second position.

4. An overlock sewing machine according to claim 1, comprising: a rotating member engaging a threading base, said rotating member resisting the spring force of the spring when the thread delivering means is in the first position.

5. An overlock sewing machine according to claim 4, comprising: means for releasing the rotating member from the threading base, and conveying the thread through the thread-guiding member when the thread-delivering member is in the second position.

6. An overlock sewing machine according to claim 1, comprising: a thread base, and wherein the thread-guiding member comprises a loop-shaped projection extending from the threading base.

7. An overlock sewing machine according to claim 6, in which a hole is formed in the thread-guiding member at least in part by said loop-shaped projection, said hole being V-shaped, and means comprising a curved portion at one tip of the hole for guiding the thread into the thread-guiding member, and means comprising a curved portion at the other tip of the hole for guiding the thread to the thread-receiving groove.

8. An overlock sewing machine according to claim 1, in which the movable lever is curved, and further comprising means for mounting the movable lever to pivot between the first position corresponding to the thread-receiving eye, and the second position corresponding to the thread-guiding member.

9. An overlock sewing machine according to claim 8, and further comprising a stopper means on the threading base for touching a portion of the movable lever and preventing the movable lever from moving past the first position when the thread-delivering member is in the first position.

10. An overlock sewing machine according to claim 8, and further comprising means for engaging a projection on the movable lever, and for holding the thread-delivering member in the second position.

11. An overlock sewing machine according to claim 8, and further comprising first set screw means for rotatably attaching movable lever to the lower end of the threading base, and second set screw means for fixing the threading base to the looper.

12. An overlock sewing machine according to claim 8, and further comprising set screw means for touching the movable lever and preventing the movable lever from moving past the second position, said set screw means further comprising means for fixing the threading base to one end of the looper.

13. An overlock sewing machine according to claim 1, and further comprising, a straight guide rail and means for mounting the movable lever on the guide rail to slide between the first position corresponding to the thread receiving eye, and the second position corresponding to the thread-guiding member.

* * * * *